US005167988A

United States Patent [19]

Yano et al.

[11] Patent Number: 5,167,988

[45] Date of Patent: Dec. 1, 1992

[54] CERAMIC COATING BONDED TO IRON MEMBER

[75] Inventors: Mitsuru Yano, Fukuoka; Norio Takahashi, Oomiya; Masatoshi Nakamizo, Kitakyushu; Tomoyuki Kido, Kitakyushu; Masatoshi Kawata, Kitakyushu; Katsumi Morikawa, Fukuoka, all of Japan

[73] Assignees: Hitachi Metals, Ltd., Tokyo; Kurosaki Refractories Co., Ltd., Fukuoka, both of Japan

[21] Appl. No.: 737,908

[22] Filed: Jul. 26, 1991

Related U.S. Application Data

[63] Continuation of Ser. No. 440,052, Nov. 21, 1989, abandoned.

[30] Foreign Application Priority Data

Nov. 21, 1988 [JP] Japan ..... 63-294427
May 1, 1989 [JP] Japan ..... 1-112496

[51] Int. Cl.[5] ..... B05D 3/06

[52] U.S. Cl. ..... 428/35.1; 428/324; 428/448; 428/454; 428/469; 428/701

[58] Field of Search ..... 428/35, 699, 701, 702, 428/324, 448, 454, 469

[56] References Cited

U.S. PATENT DOCUMENTS 4,115,313 9/1978 Lyon et al. ..... 252/309
4,174,296 11/1979 Kass ..... 252/312
4,314,573 2/1982 Spitzer ..... 132/7
4,515,778 5/1985 Kastell ..... 424/71

FOREIGN PATENT DOCUMENTS 179110 4/1981 Japan .
58-99180 12/1981 Japan .
59-12116 7/1982 Japan .
78113 10/1982 Japan .
58-51214 3/1983 Japan .
63611 9/1984 Japan .

*Primary Examiner*—Bernard D. Pianalto
*Attorney, Agent, or Firm*—Finnegan, Henderson, Farabow, Garrett & Dunner

[57] ABSTRACT

A ceramic coating bonded to an iron tubular member comprising a bonding layer formed on a surface of the iron tubular member by a reaction of an iron tubular oxide layer of the iron tubular member and a silicate; and an iron oxide diffusion-preventing layer produced from fine metal oxide particles or an organometallic binder by firing on a surface of the bonding layer. The ceramic coating may further comprises an oxidation-preventing layer, a heat-insulating layer, a refractory layer or a thin dense protective layer. It may be produced by coating the surface of the iron tubular member with a silicate binder to form a layer which is then converted to a bonding layer by a heat treatment in a steam atmosphere; coating the surface of the bonding layer with fine metal oxide particles or an organometallic binder to form an iron oxide diffusion-preventing layer; and after curing and drying firing the resulting ceramic coating in an atmosphere having an oxygen partial pressure of 10 mmHg or less.

20 Claims, 10 Drawing Sheets

CERAMIC COATING BONDED TO IRON MEMBER

This application is a continuation, of application Ser. No. 07/440,052 filed Nov. 21, 1989, now abandoned.

BACKGROUND OF THE INVENTION

The present invention relates to a ceramic coating formed on an iron tubular member for use in exhaust equipment of internal engines, etc. and a method of producing it.

For iron tubular members such as exhaust equipment of internal engines, etc., which are exposed to corrosive gases at high temperatures and severe heat shock, it was proposed to form ceramic coatings on the inner surfaces of such iron tubular members to impart them a heat resistance, a corrosion resistance and a heat shock resistance.

Big problems with such ceramic coatings are that since they are subjected to severe heat shock by a high-temperature exhaust gas, a large stress is generated in the boundaries between the ceramic coatings and the iron tubular members due to the differences in thermal expansion between them, leading to the peeling of the ceramic coatings from the iron tubular members, and that since the ceramic coatings have much smaller heat conductivity than the iron tubular members, an extremely large temperature gradient appears in the ceramic coatings by heat, thereby generating a large stress in the ceramic coatings, which leads to the peeling and cracking of the ceramic coatings.

In general, although ceramics have large compression strength, they have poor tensile strength and are extremely brittle. Accordingly, they are extremely less resistant to thermal shock.

To solve these problems, various proposals were made.

For instance, Japanese Patent Laid-Open No. 58-51214 discloses exhaust gas equipment for internal engines comprising an iron equipment body to be exposed to a high-temperature exhaust gas, an inner surface of which is coated with a refractory layer composed of a mixture of refractory material particles and a heat-resistant inorganic binder.

Japanese Patent Laid-Open No. 58-99180 discloses a method of producing exhaust gas equipment for internal engines which comprises the steps of forming a heat-resistant layer by coating an inner surface of an iron equipment body to be exposed to a high-temperature exhaust gas with a slip composed of a mixture of refractory material particles, an inorganic binder and frit: forming a, heat-insulating layer by coating the heat-resistant layer while it is in a wet state, with, heat-insulating particles: and then, after solidifying the heat-insulating layer, forming a heat-resistant layer thereon by coating the, heat-insulating layer with a slip composed of a mixture of refractory material particles, an inorganic binder and a frit. If necessary, the heat-resistant layer can be coated with a subsequent refractory, heat-insulating layer, and a subsequent heat-resistant layer repeatedly to produce a ceramic coating of a desired thickness.

However, these methods fail to provide sufficient bonding strength between the ceramic layers and the metal members, leaving the problem that ceramic layers are likely to peel off from the metal members along the bonding boundaries or in the ceramic layers themselves by heat shock. Thus, they are not satisfactory in long-period durability.

Recently, ceramic paints and coating materials containing metallic alkoxides as binders were developed. However, these materials are extremely expensive, and it is difficult to coat them in sufficient thickness for enabling them to endure use for a long period of time.

Further, Japanese Patent Laid-Open No. 59-12116 discloses a composite ceramic material comprising an inorganic hollow particles dispersed in a ceramic matrix. However, mere dispersion of inorganic hollow particles in a matrix fails to provide a coating having good bonding strength to a metal surface and high heat shock resistance, though it has sufficient heat insulation. In addition, since the inorganic hollow particles have small strength, they are easily broken, leading to the peeling and cracking of the resulting ceramic coating.

Recently, it has been found that when a ceramic coating bonded to an iron member is exposed to a corrosive exhaust gas, etc. at a high temperature for a long period of time, the corrosive exhaust gas penetrates into a ceramic layer and reaches to the boundary with the iron tubular member, thereby oxidizing the surface of the iron tubular member. Since the oxidation of the surface of the iron member generates cracks in the oxidized layer, the ceramic coating peels off easily by a mechanical shock or a heat shock. In addition, iron oxide is diffused into the coating layer, thereby causing the discoloration (blackening) of the resulting coating.

OBJECT AND SUMMARY OF THE INVENTION

An object of the present invention is, therefore, to provide a ceramic coating formed on an iron tubular member having a sufficient bonding strength and good anti-oxidation property without causing any discoloration of the coating layer due to the diffusion of iron oxide into the resulting ceramic coating, whereby there takes place no problem of peeling off in use at a high temperature for a long period of time.

Another object of the present invention is to provide a method of producing such a ceramic coating on an iron tubular member.

As a result of intense research in view of the above objects, the inventors have found that a ceramic coating, which is not likely to peel off from an iron tubular member and is resistant to discoloration even when it is exposed to a high-temperature, corrosive exhaust gas for a long period of time, can be obtained by forming a bonding layer on the iron tubular member by causing a reaction between an oxide layer of the iron tubular member and a silicate, and then forming an iron oxide diffusionpreventing layer consisting of burned metal oxide fine particles or organometallic binder, and further, if necessary, an oxidation preventing layer, a heat-insulating layer, a refractory layer and a protective layer. The present invention is based on this finding.

Thus, the ceramic coating formed on an iron tubular member according to the present invention comprises a bonding layer formed on a surface of the iron tubular member by a reaction of an iron tubular oxide layer and a silicate; and an iron oxide diffusion-preventing layer produced from fine metal oxide particles or an organometallic binder by firing on a surface of the bonding layer.

Further, the method of producing a ceramic coating on an iron tubular member according to the present invention comprises the steps of (a) coating the surface of the iron tubular member with a silicate binder to form a layer which is to be converted to a bonding layer by a subsequent heat treatment in a steam atmosphere; (b) coating the surface of the bonding layer with metal oxide fine particles or an organometallic binder to form an iron oxide diffusion-preventing layer: and (c) after curing and drying, firing the resulting ceramic coating in an atmosphere having an oxygen partial pressure of 10 mmHg or less, thereby completely bonding the bonding layer with the iron oxide diffusion-preventing layer.

DETAILED DESCRIPTION OF THE INVENTION

Figure 1A:
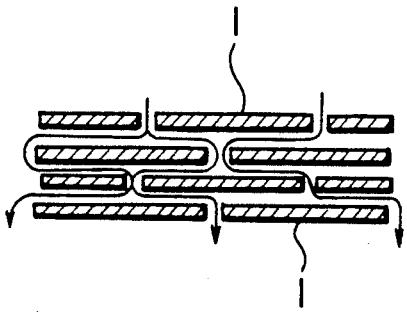
FIG. 1*a–b* is a schematic view showing the function of flaky particles in the oxidation-preventing layer according to the present invention.

The ceramic coating bonded to an iron tubular member according to the present invention comprises as indispensable layers a bonding layer and an iron oxide diffusion-preventing layer, and, if necessary, further comprises an oxidation-preventing layer, a heat-insulating layer, a refractory layer and a protective layer. Hence, as used hereinafter, the term "ceramic coating" when used in reference to the present invention refers to a multi-layer product including at least the bonding layer and the iron oxide diffusion-preventing layer. Each layer will be described in detail below.

(1) Bonding Layer

To strongly bond a ceramic to a surface of an iron tubular member, it is important that the ceramic is bonded to the surface of the iron tubular member by physical and chemical synergistic actions. The inventors have found through various research that a layer formed by a reaction between an iron oxide FeO, $Fe_3O_4$ layer and a silicate on the surface of the iron tubular member, which is simply called "bonding layer," is effective to achieve strong bonding between the iron tubular member and the ceramic coating. This bonding layer can be effectively formed by coating the surface of the iron tubular member with a silicate and subjecting the resulting coating to a heat treatment in a steam atmosphere. Since the oxide layer generated on the surface of the iron tubular member and the silicate are reacted by the above heat treatment, they are chemically strongly bonded to each other, thereby forming a good bonding layer.

The bonding layer is a dense layer not only for bonding the subsequent iron oxide diffusion-preventing layer and the iron tubular member but also for preventing the penetration of a corrosive gas through the ceramic coating to the surface of the iron tubular member from outside. The bonding layer properly has a thickness of 50 μm or less. If it exceeds 50 μm, the bonding layer is likely to peel off. The preferred thickness of the bonding layer is 2–30 μm. The term "thickness" used herein means an average thickness, and it should be noted that it may vary by 20–30% or so in the entire bonding layer.

Incidentally, in the case of a porcelain enamel, a porcelain enamel slip is applied a surface of an iron tubular member free from an oxide layer, and it is then fired and oxidized to form an oxide on the surface of the iron tubular member, thereby causing a reaction between porcelain enamel and in oxides and achieving a strong bonding of the ceramic to the surface of the iron tubular member. On the other hand, in the present invention, the surface of the iron tubular member is provided with an oxide layer of a predetermined thickness by a heat treatment in a steam atmosphere, which causes a reaction between the iron oxide layer and the silicate, thereby forming a stable bonding layer. Incidentally, in the present invention, if a sufficient bonding layer is formed, the iron oxide layer may remain to some extent without changing the effects of the present invention.

In the present invention, the bonding layer can be formed on the surface of the iron tubular member by the following method:

First, in order to improve the wettability of the surface of the iron tubular member with a silicate solution, the surface of the iron tubular member may be subjected to air blasting, etc., thereby producing extremely small roughness on the iron tubular member surface. Next, after washing, the roughened surface is coated with a silicate solution and then subjected to a heat treatment in a steam atmosphere to produce iron oxide of a low oxidation level, which is highly reactive with the silicate. Thus, a good bonding layer is formed. As a steam atmosphere, it is preferably 500° C. or higher. With respect to the heat treatment in a steam atmosphere, it may be carried out after completion of the formation of all layers, or in the intermediate step of forming the constituent layers in the ceramic coating.

Incidentally, the silicates which can be used in the present invention include sodium silicate, potassium silicate and lithium silicate, and they may be used alone or in combination. The silicate is used in a liquid state. These silicates have thermal expansion coefficients successively increasing in the order of lithium silicate, potassium silicate and sodium silicate. Thus, by properly selecting these silicates, the thermal expansion coefficient of the bonding layer can be fitted to that of the iron tubular member.

(2) Iron Oxide Diffusion-Preventing Layer

Since a liquid phase diffusion of iron oxide takes place up to the surface of the bonding layer or even to other coating layers such as the oxidation preventing layer, etc. during a long period of use, the iron oxide finally comes to exist on the ceramic coating surface, thereby, damaging a good appearance of the ceramic coating due to blackening of the ceramic coating. The above phenomenon can be effectively prevented by forming a layer of fine metal oxide particles or an organometallic binder composition, which does not form a low-melting point product with iron oxide.

The fine metal oxide particles include those showing less tendency of becoming glassy as a result of reaction with the iron oxide, such as an alumina sol, a silica sol, a chromia sol, a zirconia sol, a titania sol, etc. The organometallic binders include alkoxides of aluminum, silicon, chromium, zirconium, titanium, etc.

Since the thermal expansion coefficients of the iron tubular members such as cast iron, etc. are extremely larger than those of the metal oxides, a large thermal stress is generated due to the difference in thermal expansion between them when the thickness of the iron oxide diffusion-preventing layer consisting of the metal oxides or the organometallic binders is increased, leading to the peeling of the coating layer from the iron tubular member. Accordingly, the iron oxide diffusion-preventing layer should be made as thin as possible. Since the dense layer of alumina, silica, zirconia, etc. having a high purity is highly effective for preventing the diffusion of iron oxide, the iron oxide diffusion-preventing layer properly has a thickness of 10 μm or less, more preferably 3–6 μm. If it exceeds 10 μm, the iron oxide diffusion-preventing layer is likely to peel off.

(3) Oxidation-Preventing Layer

Ceramics generally have bending strength which is nearly ⅓ to 1/10 of their compression strength, and smaller ductility and elongation than iron products. In addition, they are extremely brittle. Therefore, high-temperature thermal shock causes strain in the ceramics, leading to their breakage.

The inventors have found through various research that an oxidation-preventing layer having a structure in which inorganic flaky particles are laminated and cross-linked is effective to eliminate these problems.

The inorganic flaky particles which can be used herein include those produced by crushing natural mica, artificially synthesized mica, thin glass films, inorganic hollow particles such as microballoons, etc. The inorganic flaky particles may have a longer diameter and a shorter diameter each within 2–74 μm or so and a thickness of 0.1–3 μm or so, their longer diameter / thickness ratio being 10 or more. More preferably, their longer diameter is 5–30 μm, their thickness 0.5–2 μm, and their ratio of longer diameter to thickness 15 or more. When the longer diameter is greater than 74 μm, their fluidity becomes low as a coating material, and the surface of the resulting coating becomes rough. When it is less than 2 μm, the particles become close to spheres, losing their advantages as flakes.

The oxidation-preventing layer can be formed by mixing the inorganic flaky particles with a silicate binder and a hardener into a slurry, applying the slurry to the iron oxide diffusion-preventing layer and then curing, drying and firing it. The silicate binder may be the same as used for the bonding layer, and the hardener may be burned aluminum phosphate, calcium silicate, etc.

The content of the inorganic flaky particles in the anti-oxidizing layer may be generally 30–60 weight% or so, and preferably 40–50 weight%.

According to the method of the present invention, a mixture of the inorganic flaky particles, the silicate binder and the hardener is applied onto the iron oxide diffusion-preventing layer in a slurry state. After applying, it is cured at 18°–30° C. or so for 8–24 hours. It is then dried to remove water sufficiently, and fired at 750°–850° C. for 0.5–1.5 hours. The burning of the anti-oxidizing layer may be conducted in a neutral atmosphere having an oxygen partial pressure of 10 mmHg or less as in the case of the bonding layer. Incidentally, the firing treatment may be conducted simultaneously on the bonding layer and the oxidation-preventing layer. For this purpose, the ceramic coating needs only be heat-treated after the formation of all layers.

In the oxidation-preventing layer thus produced, the inorganic flaky particles exist in a laminated state because of their flat shape, and cross-linked to each other by a binder.

If the flaky particles have the same weight as sphere or cobble-shaped particles generally used, the flaky particles have much larger surface area, which leads to a larger bonding area when laminated, thereby increasing a bonding strength between the particles in the layer extremely.

Figure 1B:
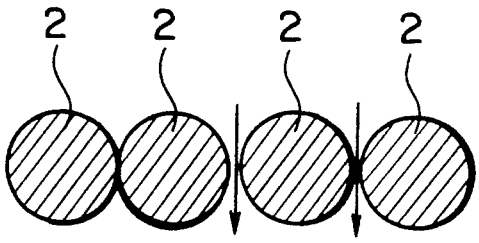

FIG. 1 schematically shows the comparison between flaky particles and sphere particles having the same material and weight stacked in a laminated state.

FIG. 1 (*a*) is a schematic view showing the flaky particles in a laminated state, and FIG. 1 (*b*) is a schematic view showing the sphere particles aligned in a line.

For instance, since the weight of a flaky particle 1 of 15 μm in length, 15 μm in width and 1 μm in thickness is equivalant to that of a sphere 2 having a diameter of 7.5 μm, and an area of the surface of the iron tubular member covered by a single flaky particle 1 corresponds to that covered by four sphere particles 2. This means that in terms of lamination efficiency, one flaky particle corresponds to 4 sphere particles. Because of large contact area between the flaky particles, a bonding strength between the flaky particles when laminated is extremely large. At the same time, a length of a path through which a corrosive gas penetrates and reaches the surface of the iron tubular member is extremely long, providing a large effect of preventing the corrosion of the iron tubular member.

The structure in which flaky particles are laminated and cross-linked is highly flexible and subjected to less cracking and peeling than the structure made by the spherical particles. Even if cracking occurs in their laminate layer, its propagation is extremely slow because of the laminated structure.

With respect to the oxidation-preventing layer, the thicker the better from the viewpoint of corrosion resistance. However, when it exceeds 1000 μm, the oxidation-preventing layer becomes likely to peel off by high-temperature heat shock. On the other hand, when it is less than 150 μm, a sufficient corrosion resistance cannot be achieved. The preferred thickness of the oxidation preventing layer is 300–700 μm.

Incidentally, to prevent the peeling of the oxidation-preventing layer, its thermal expansion coefficient is desirably as close to that of the iron tubular member as possible. Specifically, the difference in a thermal expansion coefficient between them may be up to 0.3% or so, and preferably 0–0.1%. For this purpose, it is necessary to adjust the composition of ceramic components in the oxidation-preventing layer.

Generally, ceramics have extremely small thermal expansion coefficient than the iron tubular members, but the thermal expansion coefficient of the ceramic coating can be made closer to that of the iron tubular member by increasing the amounts of $K_2O$ and $Na_2O$ in a matrix of the oxidation-preventing layer and making it glassy.

The matrix of the oxidation-preventing layer is constituted by a silicate. Usable as the silicate is one or more of sodium silicate, potassium silicate and lithium silicate in a liquid state. Among these silicates, lithium silicate, potassium silicate and sodium silicate have successively increasing thermal expansion coefficients, and the increase of the alkali content leads to a larger thermal expansion coefficient. Accordingly, by selecting these components, the thermal expansion coefficient of the oxidation-preventing layer can be fitted to that of the iron tubular member.

(4) Heat-Insulating Layer

This layer is to impart heat insulation to a ceramic coating, and it has a structure composed of a fired heat-insulating material mainly composed of inorganic hollow particles or microballoons.

The heat-insulating materials which can be used herein include inorganic hollow particles such as Sirasu (volcanic glass) balloons, foamed silica, ceramic microballoons, etc. These particles generally have an average particle size of 10-500 μm. When it is less than 10 μm, cracking and peeling due to shrinkage take place, and when it is larger than 500 μm, a flat and smooth layer cannot be easily formed. The preferred average particle size of the inorganic hollow particles is 40-200 μm.

With respect to the silicate binder, it may be the same as in the bonding layer. Specifically, it may be potassium silicate, sodium silicate, lithium silicate, etc. With respect to the hardener, burned aluminum phosphate, calcium silicate, etc. may be used.

According to the method of the present invention, a slurry mixture of the heat-insulating material, the silicate binder and the hardener is applied onto the iron oxide diffusion-preventing layer or the oxidation-preventing layer in a slurry state. After applying, it is cured at 18°-30° C. or so for 8-24 hours. It is then dried to remove water sufficiently, and burned at 750°-850° C. for 0.5-1.5 hours. The burning of the heat-insulating layer may be conducted in the same manner as in the bonding layer in a neutral atmosphere having an oxygen partial pressure of 10 mmHg or less.

Figure 19:
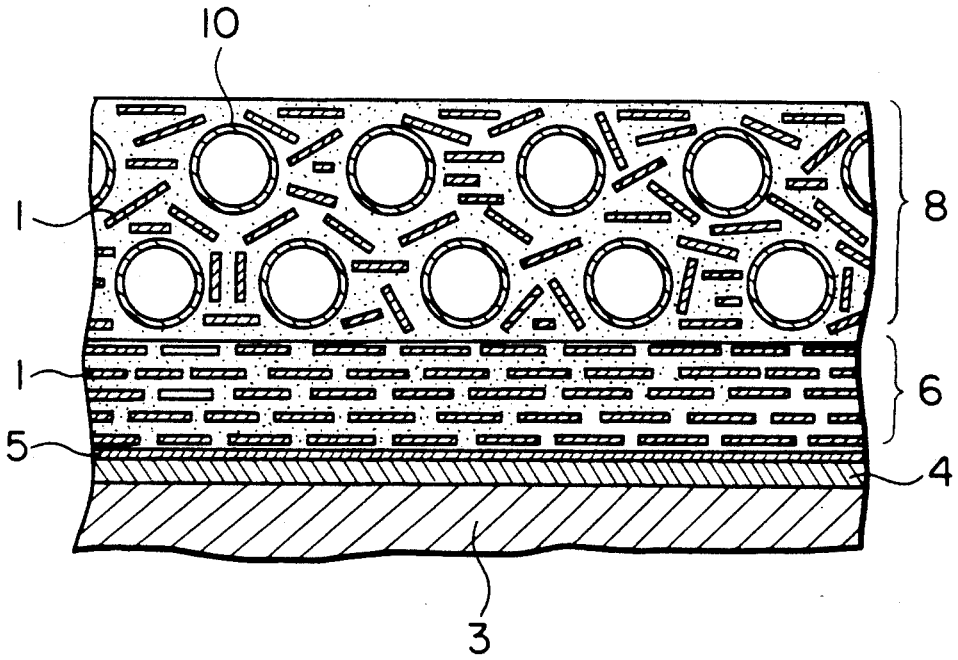

Incidentally, the heat-insulating layer may contain inorganic flaky particles as shown in FIG. 19. The inorganic flaky particles which can be used herein include those produced by crushing natural mica, artificially synthesized mica, thin glass films, inorganic hollow particles such as microballoons, etc. The inorganic flaky particles may have a longer diameter and a shorter diameter each within 2-74 μm or so and a thickness of 0.1-3 μm or so, their longer diameter / thickness ratio being 10 or more. More preferably, their longer diameter is 5-30 μm, their thickness 0.5-2 μm, and their ratio of longer diameter to thickness 15 or more. When it has a structure in which inorganic flaky particles 1 are contained, the heat-insulating layer has sufficient strength and flexibility, meaning that its peeling and cracking does not take place easily by high-temperature heat shock, and that it has an improved resistance to oxidation.

With respect to the heat-insulating layer, the thicker the better from the viewpoint of heat insulation. However, when it exceeds 1000 μm, its peeling is likely to take place by high-temperature heat shock, and when it is less than 150 μm, a sufficient heat-insulating effect cannot be obtained. The preferred thickness of the heat-insulating layer is 300-800 μm.

(5) Refractory Layer

This layer is formed to impart heat resistance to the ceramic coating, and it has a structure produced by burning a refractory material based on inorganic particles.

The refractory layer can be formed by applying a slurry mixture of a refractory material, a silicate binder and a hardener onto the dried surface of the iron oxide diffusion-preventing layer, the anti-oxidizing layer or the heat-insulating layer, curing and drying, and then burning it in a neutral atmosphere having an oxygen partial pressure of 10 mmHg or less.

The refractory materials which can be used herein include chamotte, alumina, zircon, zirconia and any other refractory materials which are generally used. Among them, zirconia is preferable because it has a low thermal conductivity, and high thermal expansion coefficient.

The refractory material powder has generally an average particle size of 10-500 μm. When it is smaller than 10 μm, agglomeration of refractory particles is likely to take place, making it difficult to form a flat layer and also making it likely that it is shrinked under the influence of high temperature. On the other hand, when it is larger than 500 μm, a flat layer is difficult to form. The preferred average particle size of the refractory powder is 20-200 μm.

Incidentally, the silicate binder and the hardener may be the same as used in the heat-insulating layer.

With respect to the conditions of curing, drying and burning to form the refractory layer, they may be essentially the same as in the formation of the heat-insulating layer.

With respect to a thickness of this layer, the larger the better from the viewpoint of heat resistance, but when it exceeds 2000 μm, it is likely to peel off by high-temperature heat shock. And when it is less than 100 μm, a sufficient heat resistance effect cannot be obtained. The preferred thickness of the refractory layer is 200-800 μm.

(6) Protective Layer

This layer is a thin, dense ceramic layer formed on the dried surface of the iron oxide diffusion-preventing layer, the oxidation-preventing layer, the heat-insulating layer or the refractory layer for preventing a corrosive gas from penetrating from the surface.

The protective layer is composed of an inorganic binder and/or an organometallic binder, and it may be formed by applying the inorganic binder and/or the organometallic binder to the dried, outermost surface of the ceramic coating layers (the iron oxide diffusion-preventing layer, the oxidation-preventing layer, the heat-insulating layer or the refractory layer) and then burning it in an atmosphere having an oxygen partial pressure of 10 mmHg or less.

If the inorganic binder and/or the organometallic binder can be stabilized only by drying, the protective layer can be formed only by applying the inorganic binder and/or the organometallic binder onto the surface of the iron oxide diffusion-preventing layer, the oxidation-preventing layer, the heat-insulating layer or the refractory layer after burning, and then drying.

The inorganic materials which can be used include a silica sol, an alumina sol, solutions of alkali silicates such as sodium silicate, potassium silicate and lithium silicate, an aluminum phosphate solution, etc.

The organometallic materials which can be used may be those containing, as main components, silicon alkoxide, zirconium alkoxide, etc.

It is difficult to fit the thermal expansion coefficient of this layer to that of the iron tubular member due to the inherent difference in materials. Therefore, it is necessary that the protective layer has as small a thickness as 15 μm or less. When it exceeds 15 μm, a large stress exists in the protective layer because of the difference in thermal expansion coefficient between the protective layer and the iron tubular member, making it likely that it is peeled off and cracked. The preferred thickness of the protective layer is 3-10 μm. With respect to the bonding layer, the iron oxide diffusion-preventing layer, the heat-insulating layer, the refractory layer and the protective layer explained above, it should be noted that all of these layers need not exist except for the bonding layer and the iron oxide diffusion-preventing layer. The preferred combinations of layers making up the ceramic coatings according to the present invention are as follows:

(a) Bonding layer + iron oxide diffusion-preventing layer.

(b) Bonding layer + iron oxide diffusion-preventing layer + oxidation-preventing layer.

(c) Bonding layer + iron oxide diffusion-preventing layer + oxidation-preventing layer + protective layer.

(d) Bonding layer + iron oxide diffusion-preventing layer + oxidation-preventing layer + heat-insulating layer.

(e) Bonding layer + iron oxide diffusion-preventing layer + oxidation-preventing layer + heat-insulating layer + protective layer.

(f) Bonding layer + iron oxide diffusion-preventing layer + oxidation-preventing layer + refractory layer.

(g) Bonding layer + iron oxide diffusion-preventing layer + oxidation-preventing layer + refractory layer + protective layer.

(h) Bonding layer + iron oxide diffusion-preventing layer + oxidation-preventing layer + heat-insulating layer + refractory layer.

(i) Bonding layer + iron oxide diffusion-preventing layer + oxidation-preventing layer + heat-insulating layer + refractory layer + protective layer.

(j) Bonding layer + iron oxide diffusion-preventing layer + protective layer.

(k) Bonding layer + iron oxide diffusion-preventing layer + heat-insulating layer (l) Bonding layer + iron oxide diffusion-preventing layer + heat-insulating layer + protective layer.

(m) Bonding layer + iron oxide diffusion-preventing layer + refractory layer (n) Bonding layer + iron oxide diffusion-preventing layer + refractory layer + protective layer.

(o) Bonding layer + iron oxide diffusion-preventing layer + heat-insulating layer + refractory layer.

(p) Bonding layer + iron oxide diffusion-preventing layer + heat-insulating layer + refractory layer + protective layer.

The present invention will be described in detail referring to the following Examples.

EXAMPLE 1

Figure 3:
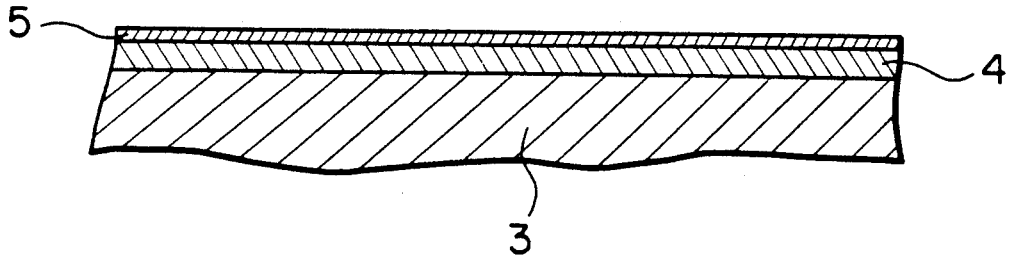
FIGS. 3–19 are cross-sectional views schematically showing the ceramic coating formed on an iron tubular member in each Example.

FIG. 3 is a view schematically showing the cross section of a ceramic coating consisting of a bonding layer 4 formed on an iron tubular member 3 and an iron oxide diffusion-preventing layer 5.

Figure 2:
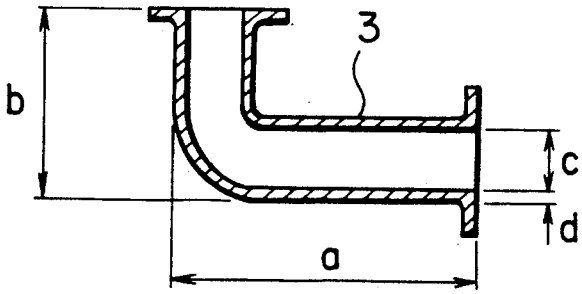
FIG. 2 is a cross-sectional view showing one example of an iron tubular member to which the present invention is applicable.

To form a bonding layer on each of the inner and outer surfaces of an L-shaped iron tubular member 3 made of vermicular cast iron and having a shape as shown in FIG. 2 (long arm a: 200 mm, short arm b: 120 mm, inner diameter c: 40 mm, thickness d: 3 mm), the inner and outer surfaces of this iron tubular member 3 were air-blasted and washed with a diluted potassium silicate (concentration: 5 weight %). The iron tubular member 3 was then immersed in a potassium silicate solution ($SiO_2/K_2O$ molar ratio: 3.0, concentration: 10 weight%) for 3 minutes and then excess potassium silicate was removed. After keeping it at room temperature for 1 hour, it was placed in a furnace having a heated steam atmosphere controlled at 550° C. for 90 minutes to form an iron oxide layer and to cause a reaction between the resulting iron oxide layer and the coated potassium oxide, and then cooled to room temperature.

Next, to form an iron oxide diffusion-preventing layer 5 on a surface of the bonding layer 4 thus obtained, the iron tubular member 3 was immersed in a silica sol containing 20% of $SiO_2$ (SNOWTEX 40, manufactured by Nissan Chemical Industries, Ltd.) for 10 seconds. After that, an excess silica sol was removed, and the resulting ceramic coating was cured at room temperature for 1 hour.

Next, this iron tubular member 3 was dried by heating from room temperature to 300° C. at a heating rate of 1° C./minute in a drying furnace, kept at 300° C. for 1 hour and then cooled to room temperature to remove excess water.

This iron tubular member 3 was then heated to 800° C. at a heating rate of 200° C./hr in an $N_2$ atmosphere (oxygen partial pressure: 5 mmHg) in a furnace, kept at 800° C. for 1 hour and then cooled to room temperature without being taken out of the furnace, thereby consolidating the bonding layer 4 and the iron oxide diffusion-preventing layer 5.

The resulting ceramic coating shown in FIG. 3 and a bonding layer 4 having a thickness of about 10 μm, and an iron oxide diffusion-preventing layer 5 having a thickness of 3 μm.

EXAMPLE 2

Figure 4:
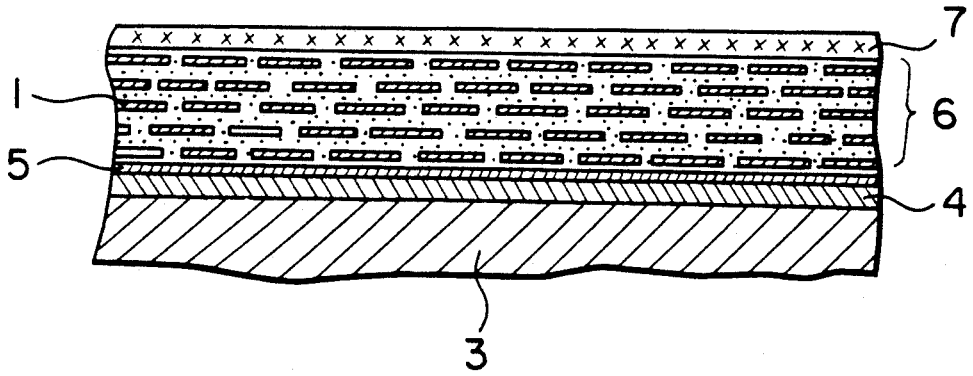

FIG. 4 is a view schematically showing the cross section of a ceramic coating formed on each of inner and outer surfaces of the iron tubular member 3, consisting of a bonding layer 4, an iron oxide diffusion-preventing layer 5, an oxidation preventing layer 6, and a protective layer 7.

The bonding layer 4 was formed in the same manner as in Example 1. Next, to form the iron oxide diffusion-preventing layer 5 on a dried surface of the bonding layer 4, the iron tubular member 3 was immersed in an alumina sol containing 10% of $Al_2O_3$ (AS 520, manufactured by Nissan Chemical Industries, Ltd.) for 10 seconds. After that, an excess alumina sol was removed, and the resulting iron tubular member was cured at room temperature for 1 hour.

Next, to form the oxidation preventing layer 6, inorganic flaky particles consisting essentially of crushed particles of Sirasu ballons (Winlight MSB-5021, manufactured by Ijichi Chemical Co., Ltd.), a silicate binder and a hardener (Reforpack II, manufactur ed by Aichi Chemical Co., Ltd.) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Flaky particles (<74 μm) | 30 parts by weight |
| Burned aluminum phosphate (<74 μm) | 10 parts by weight |

The above mixture slurry was applied to the iron oxide diffusion-preventing layer 5 on the inner surface of the iron tubular member 3, cured for 2 hours and then applied again to form a double-layered oxidating-preventing layer 6.

In this state, it was cured at room temperature for 15 hours to cause a hardening reaction of sodium silicate and burned aluminum phosphate in the iron oxide diffusion-preventing layer.

Next, this iron tubular member 3 was heated (fired) from room temperature to 300° C. at a heating rate of 1° C./minute in a drying furnace, kept at 300° C. for 1 hour and then cooled to room temperature to remove excess water.

This iron tubular member 3 was then heated (fired) to 800° C. at a heating rate of 200° C./hr in an $N_2$ atmosphere (oxygen partial pressure: 5 mmHg) in a furnace, kept at 800° C. for 1 hour and then cooled to room temperature without being taken out of the furnace, thereby consolidating the bonding layer 4, the iron oxide diffusion-preventing layer 5 and the oxidation-preventing layer 6.

Further, a silica sol was applied to the oxidation-preventing layer 6 formed on the inner and outer surfaces of the iron tubular member 3, and the iron tubular member 3 was dried by heating to 110° C. at a heating rate of 10° C./minute, kept at 110° C. for 1 hour and then cooled to room temperature to form the protective layer 7 having a thickness of 8 μm.

The resulting ceramic coating shown in FIG. 4 had a bonding layer 4 having a thickness of about 10 μm, an iron oxide diffusion-preventing layer 5 having a thickness of 3 μm, an oxidation-preventing layer 6 having a thickness of about 300 μm in which flaky particles of 0.5-2 μm in thickness and 5-20 μm in length were laminated in a cross-linked manner, and a thin, dense surface layer 7 having a thickness of about 8 μm.

COMPARATIVE EXAMPLES 1 and 2

Coating layers were produced as ceramic coatings of Comparative Examples 1 and 2 in the same manner as in Examples 1 and 2 without forming an iron oxide diffusion-preventing layer.

To evaluate the properties of the ceramic coatings of Examples 1, 2 and Comparative Exmaples 1, 2, the following tests were conducted.

(1) Test for Measuring Weight Gain by Oxidation

Each of the above iron tubular members 3 provided with ceramic coatings was attached to an apparatus which generated a high-temperature gas by burning a propane gas to heat an inner surface of each iron tubular member 3. The test was conducted under the following conditions:

| | |
|---|---|
| Primary air flow | 50 $Nm^3$/hr |
| Propane gas flow | 2 $Nm^3$/hr |
| Gas temperature | 980° C. |
| Oxygen concentration | 11% |

The weight gains by oxidation are shown in Table 1.

TABLE 1

| | Weight Gain by Oxidation (Unit: g) after | | | | |
|---|---|---|---|---|---|
| Sample No. | 10 hr. | 25 hr. | 40 hr. | 54 hr. | 70 hr. |
| Example 1 | 0.81 | 1.77 | 2.01 | 2.60 | 3.03 |
| Example 2 | 0.04 | 0.40 | 0.61 | 0.87 | 1.06 |
| Comparative Example 1 | 1.14 | 2.51 | 2.98 | 3.52 | 4.24 |
| Comparative Example 2 | 0.06 | 0.54 | 0.81 | 1.17 | 1.42 |
| Uncoated Iron Tubular Member | 1.56 | 3.48 | 4.19 | 5.10 | 6.05 |

Incidentally, with respect to the temperature of the inner surface of the iron tubular member, it was 585° C. in Example 1, 620° C. in Example 2, and 580° C. in the uncoated iron tubular member.

(2) Durability Test

The iron tubular members 3 of Examples 1 and 2 were repeatedly subjected to 100 cycles of a heating and cooling test in the heating evaluation apparatus.

The conditions of heating and cooling cycle were as follows:

| | |
|---|---|
| Primary air flow | 300 $Nm^3$/hr |
| Propane gas flow | 12 $Nm^3$/hr |
| Secondary air flow | 200 $Nm^3$/hr |
| Gas temperature | 1050° C. |
| Oxygen concentration | 15% |
| Temperature of outer surface of iron tubular member | 780° C. (coated) |
| Heating rate | 1000° C./min |
| Heating time | 30 min |
| Cooling in the air | 30 min |

As a result of the above test, the ceramic coatings of the present invention suffered from no cracking and peeling at all, confirming that they had sufficient durability.

Although the iron tubular members were coated with ceramic layers on their inner and outer surfaces in these Examples, it is of course possible to coat only the inner surface of the iron tubular member with a ceramic layer.

(3) Discoloration Test

Each iron tubular member 3 was placed in the internal heating evaluation apparatus and subjected to a discoloration test on the coating layers on the inner and outer surfaces of the iron tubular member 3 by a continuous heating method under the following conditions:

| | |
|---|---|
| Surface temperature of iron tubular member | 750° C. |
| Primary air flow | 30 $Nm^3$/hr |
| Propane gas flow | 1.2 $Nm^3$/hr |
| Oxygen concentration | 5% |
| Heating time | 30 hours |

The results of the above test are shown in Table 2.

TABLE 2

| | Discoloration Test by Heating | | |
|---|---|---|---|
| Sample No. | Surface Deposition of Iron Oxide | Color of Coating Layer | Surface Condition of Coating Layer |
| Example 1 | None | Black | Glossy |
| Example 2 | None | White | No change, in color |
| Comparative Example 1 | Deposited on entire surface | Brown | Rough |
| Comparative Example 2 | Spotted Deposition | Black Spots | Rough |

As is clear from Table 2, the iron tubular members of Comparative Examples 1 and 2 which did not have iron oxide diffusion-preventing layers showed an extreme diffusion of iron oxide in the coating layers. On the other hand, the iron tubular members of Examples 1 and 2 having the iron oxide diffusion-preventing layers showed good durability without suffering from substantially no discoloration.

EXAMPLE 3

Figure 5:
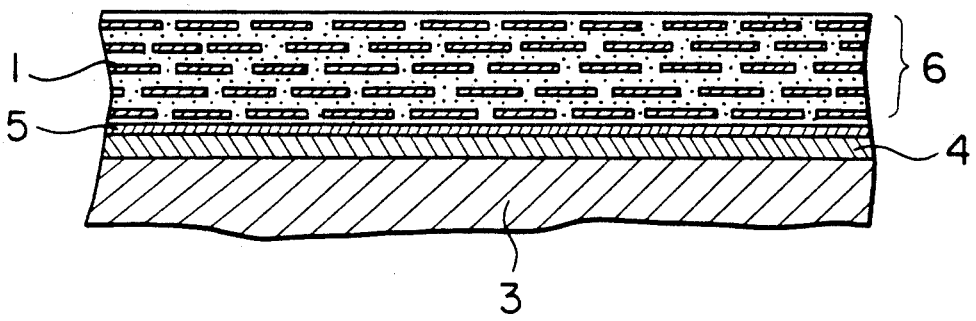

FIG. 5 is a cross-sectional view schematically showing a ceramic coating consisting of a bonding layer 4 formed on the inner surface of the iron tubular member 3, an iron oxide diffusion-preventing layer 5 produced from an alumina sol, and an oxidation-preventing layer 6.

The bonding layer 4, the iron oxide diffusion-preventing layer 5 and the oxidation-preventing layer 6 were formed in the same manner as in Example 2.

EXAMPLE 4

Figure 6:
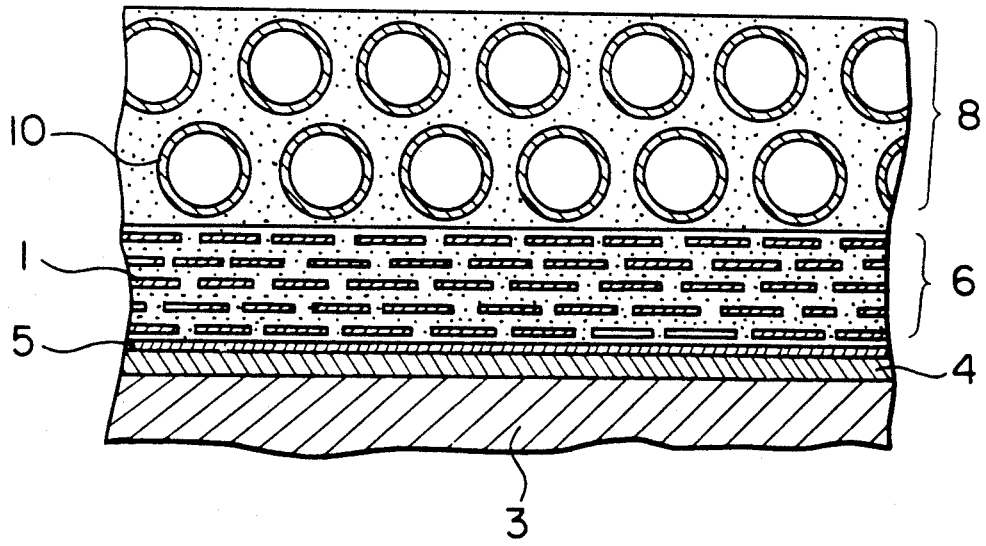

FIG. 6 is a cross-sectional view schematically showing a ceramic coating consisting of a bonding layer 4 formed on the inner surface of the iron tubular member 3, an iron oxide diffusion-preventing layer 5, an oxidation-preventing layer 6 and a heat-insulating layer 8.

The bonding layer 4, the iron oxide diffusion-preventing layer 5 and the oxidation-preventing layer 6 were formed in the same manner as in Example 3. After that, for the heat-insulating layer 8, heat-insulating material powder (Sirasu balloon having a bulk density of 0.2 and a particle size of 44–150 μm), sodium silicate (a silicate binder) and burned aluminum phosphate (a hardener) Reforpack II were mixed in the following ratio to form a mixture slurry.

| | |
|---|---|
| Sodium silicate ($SiO_2/Na_2O$ molar ratio: 3.0, concentration: 30 weight %) | 100 parts by weight |
| Sirasu balloon (<74 μm) | 10 parts by weight |
| Burned aluminum phosphate (<74 μm) | 10 parts by weight |

The above mixture slurry was applied to the dried oxidation-preventing layer 6 formed on the inner surface of the iron tubular member 3 and cured for 2 hours, and this cycle was repeated to form the heat-insulating layer 8.

In this state, it was cured at room temperature for 15 hours to cause a hardening reaction of sodium silicate and burned aluminum phosphate in the heat-insulating layer.

Next, this iron tubular member 3 was dried by heating from room temperature to 300° C. at a heating rate of 1° C./minute in a drying furnace, kept at 300° C. for 1 hour and then cooled to room temperature to remove excess water.

This iron tubular member 3 was then dried by heating to 800° C. at a heating rate of 200° C./hr in an $N_2$ atmosphere (oxygen partial pressure: 5 mmHg), kept at 800° C. for 1 hour and then cooled to room temperature, thereby hardening the heat-insulating layer 8 having a thickness of 1500 μm.

EXAMPLE 5

Figure 7:
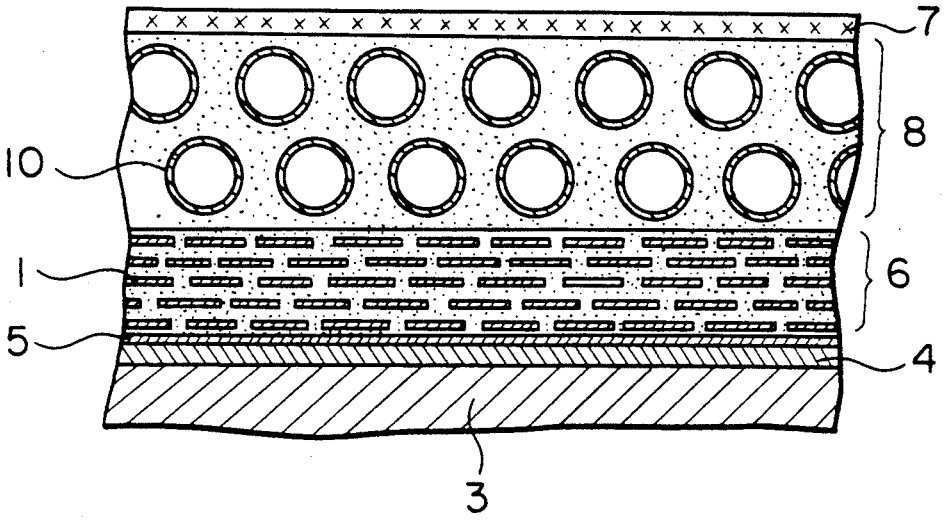

FIG. 7 is a cross-sectional view schematically showing a ceramic coating consisting of a bonding layer 4 formed on the inner surface of the iron tubular member 3, an iron oxide diffusion-preventing layer 5, an oxidation-preventing layer 6, a heat-insulating layer 8 and a protective layer 7.

The bonding layer 4, the iron oxide diffusion-preventing layer 5, the oxidation-preventing layer 6 and the heat-insulating layer 8 were formed and fired in the same manner as in Example 4. After that, an aluminum phosphate solution (concentration: 40 weight%) was applied to a surface of the heat-insulating layer 8, and dried by heating to 110° C. at a heating rate of 10° C./min and kept at 110° C. for 1 hour and then cooled to room temperature to form the protective layer 7 of 8 μm in thickness.

EXAMPLE 6

Figure 8:
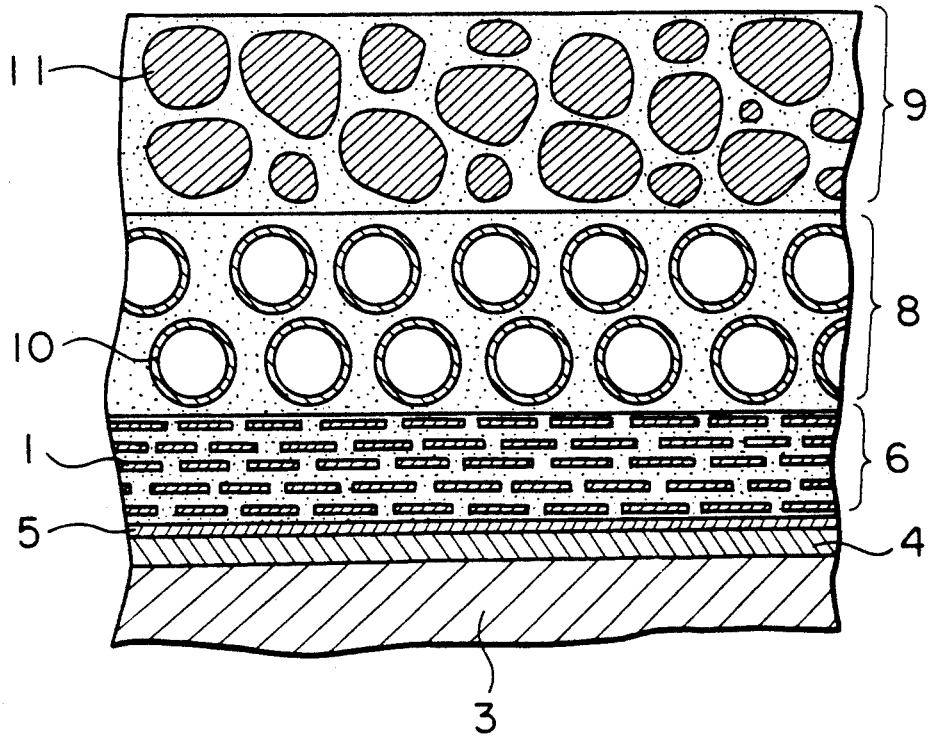

FIG. 8 is a cross-sectional view schematically showing a ceramic coating consisting of a bonding layer 4 formed on the inner surface of the iron tubular member 3, an iron oxide diffusion-preventing layer 5, an oxidation-preventing layer 6, a heat-insulating layer 8 and a refractory layer 9.

The bonding layer 4, the iron oxide diffusion-preventing layer 5, the oxidation-preventing layer 6 and the heat-insulating layer 8 were formed in the same manner as in Example 4. After that, refractory material powder (FSD #350 manufactured by Daiichi Kigenso K.K., stabilized zirconia having a particle size of 44–150 μm), sodium silicate (a silicate binder) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Stabilized zirconia (<74 μm) | 170 parts by weight |
| Burned aluminum phosphate (<74 μm) | 10 parts by weight |

This mixture slurry was applied to the dried surface of the heat-insulating layer 8 formed on the inner surface of the iron tubular member 3 and cured for 2 hours, and this cycle was repeated to form the refractory layer 9.

In this state, it was cured at room temperature for 15 hours to cause a hardening reaction of sodium silicate and burned aluminum phosphate to take place in the refractory layer.

Next, this iron tubular member 3 was dried by heating from room temperature to 300° C. at a heating rate of 1° C./min in a drying furnace, kept at 300° C. for 1 hour and then cooled to room temperature to remove excess water.

This iron tubular member 3 was then fired to 800° C. at a heating rate of 200° C./hr in an $N_2$ atmosphere (oxygen partial pressure: 5 mmHg), kept at 800° C. for 1 hour and then cooled to room temperature, thereby consolidating the refractory layer 9 of 1000 μm in thickness and the heat-insulating layer 8.

EXAMPLE 7

Figure 9:
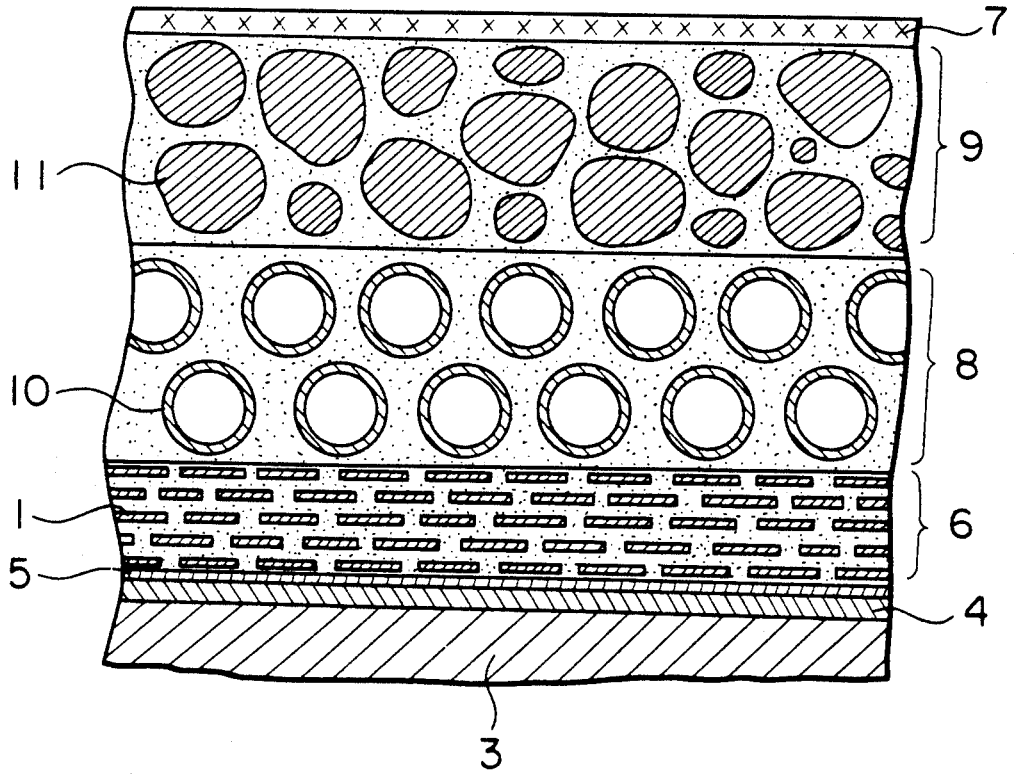

FIG. 9 is a cross-sectional view schematically showing a ceramic coating consisting of a bonding layer 4 formed on the inner surface of the iron tubular member 3, an iron oxide diffusion-preventing layer 5, an anti-oxidizing layer 6, a heat-insulating layer 8, a refractory layer 9 and a protective layer 7.

The bonding layer 4, the iron oxide diffusion-preventing layer 5, the oxidation-preventing layer 6, the heat-insulating layer 8 and the refractory layer 9 were formed in the same manner as in Example 6. After that, an aluminum phosphate solution (concentration: 40 weight %) was applied to the dried surface of the refractory layer 9, heated to 110° C. at a heating rate of 10° C./min, kept at 110° C. for 1 hour and cooled to room temperature to form the protective layer 7 of 8 μm in thickness.

EXAMPLE 8

Figure 10:
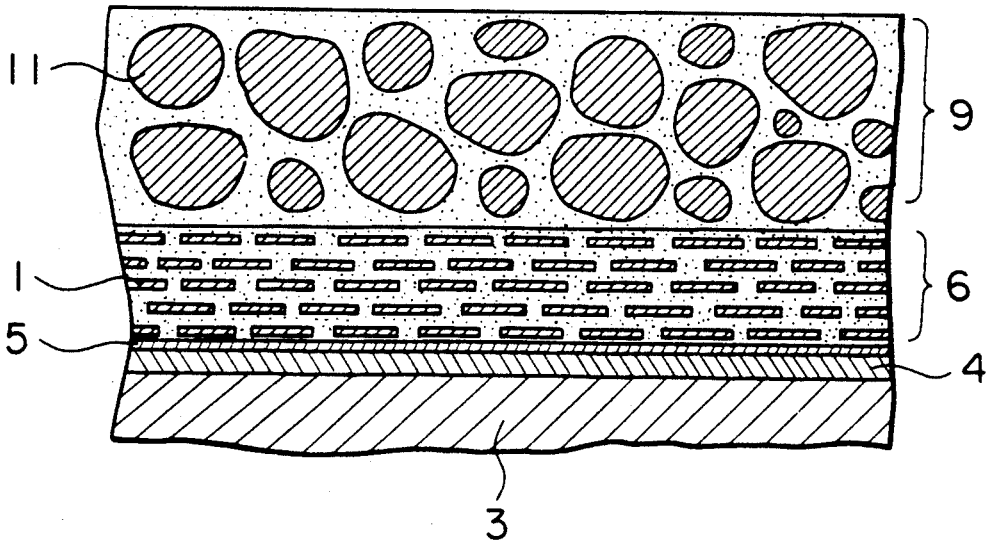

FIG. 10 is a cross-sectional view schematically showing a ceramic coating consisting of a bonding layer 4 formed on the inner surface of the iron tubular member 3, an iron oxide diffusion-preventing layer 5, an oxidation-preventing layer 6 and a refractory layer 9.

The bonding layer 4, the iron oxide diffusion-preventing layer 5 and the anti-oxidizing layer 6 were formed in the same manner as in Example 3. After that, refractory material powder (alumina having a particle size of 44–150 μm), sodium silicate (a silicate binder) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Alumina (<74 μm) | 100 parts by weight |
| Burned aluminum phosphate (<74 μm) | 10 parts by weight |

The above mixture slurry was applied to the dried surface of the anti-oxidizing layer 6 formed on the inner surface of the iron tubular member 3 and cured for 2 hours, and this cycle was repeated to form the refractory layer 9.

In this state, it was cured at room temperature for 15 hours to cause a hardening reaction of sodium silicate and burned aluminum phosphate to take place in the refractory layer.

This iron tubular member 3 was then dried by heating from room temperature to 300° C. at a heating rate of 1° C./min in a drying furnace, kept at 300° C. for 1 hour and cooled to room temperature to remove excess water.

Next, this iron tubular member 3 was fired to 800° C. at a heating rate of 200° C./hr in an $N_2$ atmosphere (oxygen partial pressure: 5 mmHg), kept at 800° C. for 1 hour and then cooled to room temperature, thereby hardening the refractory layer 9 of 1000 μm in thickness.

EXAMPLE 9

Figure 11:
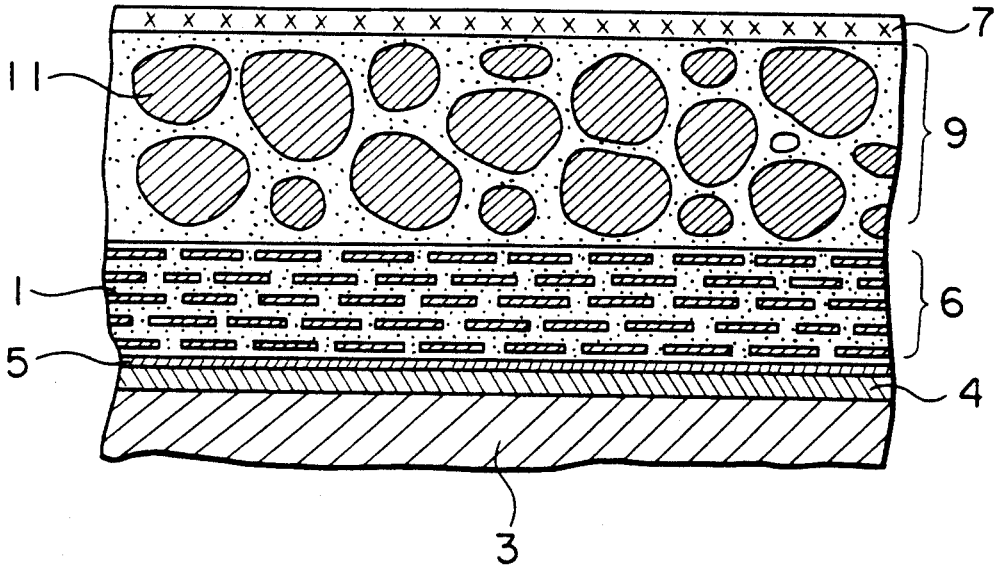

FIG. 11 is a cross-sectional view schematically showing a ceramic coating consisting of a bonding layer 4 formed on the inner surface of the iron tubular member 3, an iron oxide diffusion-preventing layer 5, an oxidation-preventing layer 6, a refractory layer 9 and a protective layer 7.

The bonding layer 4, the iron oxide diffusion-preventing layer 5, the anti-oxidizing layer 6 and the refractory layer 9 were formed in the same manner as in Example 8. After that, an aluminum phosphate solution (concentration: 40 weight %) was applied to the dried surface of the refractory layer 9, heated to 110° C. at a heating rate of 10° C./min, kept at 110° C. for 1 hour and then cooled to room temperature to form the protective layer 7 of 8 μm in thickness.

EXAMPLE 10

Figure 12:
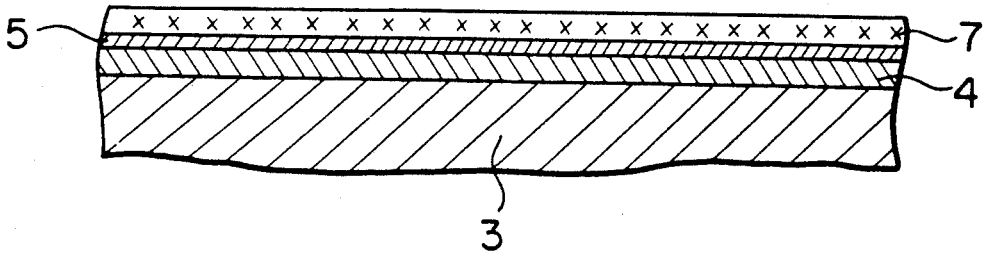

FIG. 12 is a cross-sectional view schematically showing a ceramic coating consisting of a bonding layer 4 formed on the inner surface of the iron tubular member 3, an iron oxide diffusion-preventing layer 5 and a protective layer 7.

The bonding layer 4 and the iron oxide diffusion-preventing layer 5 were formed in the same manner as in Example 1. After that, an aluminum phosphate solution (concentration: 40 weight %) was applied to the dried surface of the iron oxide diffusion-preventing layer 5, dried by heating to 110° C. at a heating rate of 10° C./min, kept at 110° C. for 1 hour and then cooled to room temperature to form the protective layer 7 of 8 μm in thickness.

EXAMPLE 11

Figure 13:
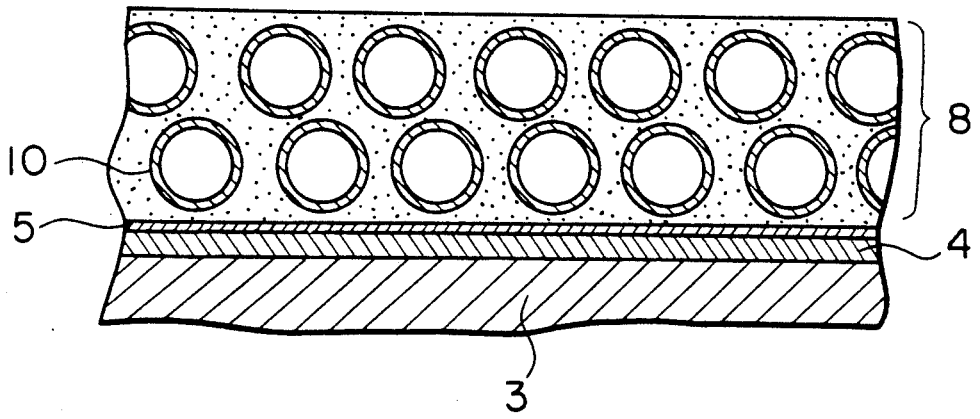

FIG. 13 is a cross-sectional view schematically showing a ceramic coating consisting of a bonding layer 4 formed on the inner surface of the iron tubular member 3, an iron oxide diffusion-preventing layer 5 and a fired-insulating layer 8.

The bonding layer 4 and the iron oxide diffusion-preventing layer 5 were formed in the same manner as in Example 1. After that, for the heat-insulating layer 8, heat-insulating material powder (Sirasu balloon having a bulk density of 0.2 and a particle size of 44–150 μm), sodium silicate (a silicate binder) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Sirasu balloon (<74 μm) | 10 parts by weight |
| Burned aluminum phosphate (<74 μm) | 10 parts by weight |

The above mixture slurry was applied to the dried iron oxide diffusion-preventing layer 5 formed on the inner surface of the iron tubular member 3 and cured for 2 hour, and this cycle was repeated to form a heat-insulating layer 8.

In this state, it was cured at room temperature for 15 hours to cause a hardening reaction of sodium silicate and burned aluminum phosphate in the heat-insulating layer.

Next, this iron tubular member 3 was dried by heating from room temperature to 300° C. at a heating rate of 1° C./minute in a drying furnace, kept at 300° C. for 1 hour and then cooled to room temperature to remove excess water.

This iron tubular member 3 was then fired to 800° C. at a heating rate of 200° C./hr in an $N_2$ atmosphere (oxygen partial pressure: 5 mmHg), kept at 800° C. for 1 hour and then cooled to room temperature, thereby consolidating heat-insulating layer 8 having a thickness of 1500 μm.

EXAMPLE 12

Figure 14:
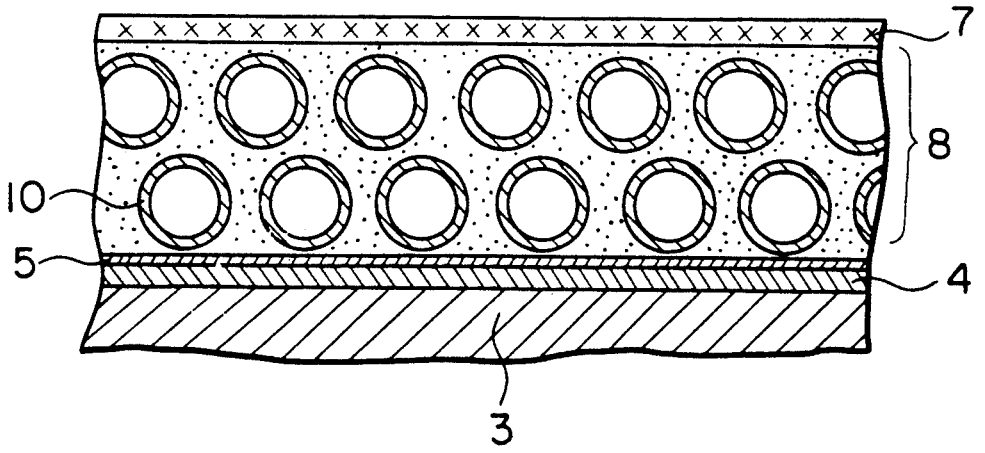

FIG. 14 is a cross-sectional view schematically showing a ceramic coating consisting of a bonding layer 4 formed on the inner surface of the iron tubular member 3, an iron oxide diffusion-preventing layer 5, a heat-insulating layer 8 and a protective layer 7.

The bonding layer 4, the iron oxide diffusion-preventing layer 5 and the heat-insulating layer 8 were formed in the same manner as in Example 11. After that, an aluminum phosphate solution (concentration: 40 weight %) was applied to the fired surface of the heat-insulating layer 8, heated to 110° C. at a heating rate of 10° C./min, kept at 110° C. for 1 hour and then cooled to room temperature to form the protective layer 7 of 8 μm in thickness.

EXAMPLE 13

Figure 15:
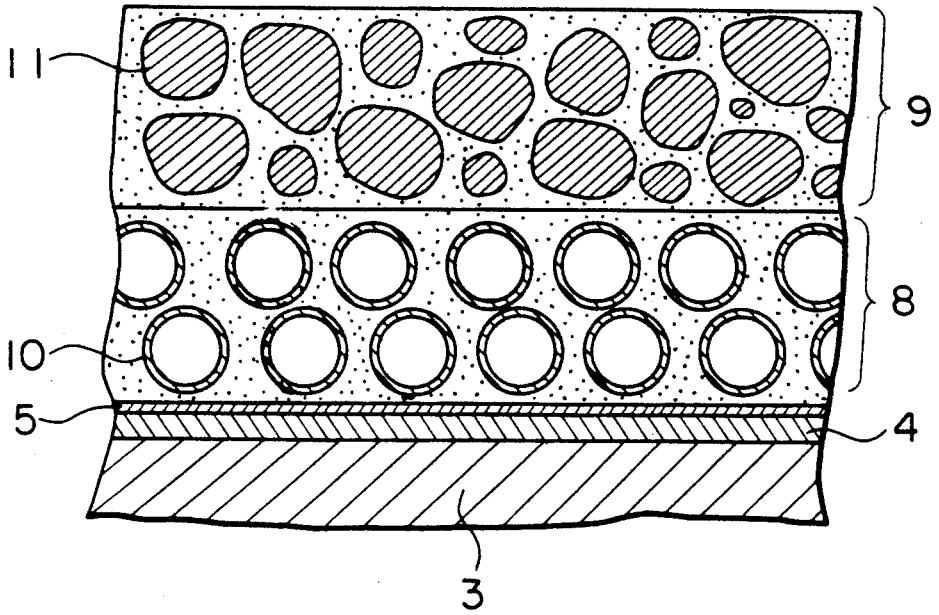

FIG. 15 is a cross-sectional view schematically showing a ceramic coating consisting of a bonding layer 4 formed on the inner surface of the iron tubular member 3, an iron oxide diffusion-preventing layer 5, a heat-insulating layer 8 and a refractory layer 9.

The bonding layer 4, the iron oxide diffusion-preventing layer 5 and the heat-insulating layer 8 were formed in the same manner as in Example 11. After that, refractory material powder (stabilized zirconia having a particle size of 44–150 μm), sodium silicate (a silicate binder) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Stabilized zirconia (<74 μm) | 170 parts by weight |
| Burned aluminum phosphate (<74 μm) | 10 parts by weight |

This mixture slurry was applied to the dried surface of the heat-insulating layer 8 formed on the inner surface of the iron tubular member 3 and cured for 2 hours, and this cycle was repeated to form the refractory layer 9.

In this state, it was cured at room temperature for 15 hours to cause a hardening reaction of sodium silicate and burned aluminum phosphate to take place in the refractory layer.

Next, this iron tubular member 3 was dried by heating from room temperature to 300° C. at a heating rate of 1° C./min in a drying furnace, kept at 300° C. for 1 hour and then cooled to room temperature to remove excess water.

This iron tubular member 3 was then fired to 800° C. at a heating rate of 200° C./hr in an $N_2$ atmosphere (oxygen partial pressure: 5 mmHg), kept at 800° C. for 1 hour and then cooled to room temperature, thereby consolidating the refractory layer 9 of 1000 μm in thickness together with the heat-insulating layer 8 and the iron oxide diffusion-preventing layer 5.

EXAMPLE 14

Figure 16:
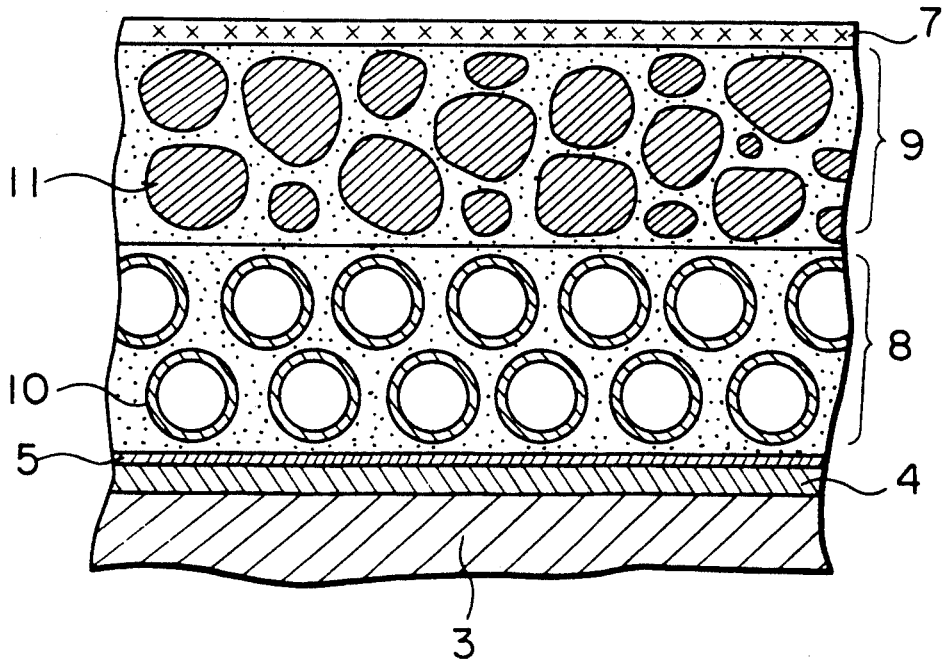

FIG. 16 is a cross-sectional view schematically showing a ceramic coating consisting of a bonding layer 4 formed on the inner surface of the iron tubular member 3, an iron oxide diffusion-preventing layer 5, a heat-insulating layer 8, a refractory layer 9 and a protective layer 7.

The bonding layer 4, the iron oxide diffusion-preventing layer 5, the heat-insulating layer 8 and the refractory layer 9 were formed in the same manner as in Example 13. After that, an aluminum phosphate solution (concentration: 40 weight %) was applied to the fired surface of the refractory layer 9, heated to 110° C. at a heating rate of 10° C./min, kept at 110° C. for 1 hour and cooled to room temperature to form a protective layer 7 of 8 μm in thickness.

EXAMPLE 15

Figure 17:
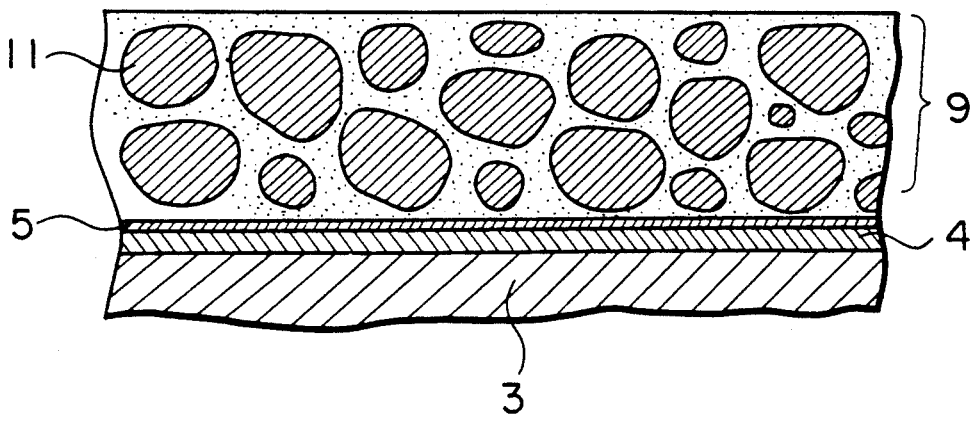

FIG. 17 is a cross-sectional view schematically showing a ceramic coating consisting of a bonding layer 4 formed on the inner surface of the iron tubular member 3, an iron oxide diffusion-preventing layer 5 and a refractory layer 9.

The bonding layer 4 and the iron oxide diffusion-preventing layer 5 were formed in the same manner as in Example 1. After that, refractory material powder (alumina having a particle size of 44–150 μm), sodium silicate (a silicate binder) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Alumina (<74 μm) | 100 parts by weight |
| Burned aluminum phosphate (<74 μm) | 10 parts by weight |

The above mixture slurry was applied to the dried surface of the iron oxide diffusion-preventing layer 5 formed on the inner surface of the iron tubular member 3 and cured for 2 hours, and this cycle was repeated to form the refractory layer 9.

In this state, it was cured at room temperature for 15 hours to cause a hardening reaction of sodium silicate and burned aluminum phosphate to take place in the refractory layer.

Next, this iron tubular member 3 was dried by heating from room temperature to 300° C. at a heating rate of 1° C./min in a drying furnace, kept at 300° C. for 1 hour and cooled to room temperature to remove excess water.

This iron tubular member 3 was then fired to 800° C. at a heating rate of 200° C./hr in an $N_2$ atmosphere (oxygen partial pressure: 5 mmHg), kept at 800° C. for 1 hour and then cooled to room temperature, thereby consolidating the refractory layer 9 of 1000 μm in thickness.

EXAMPLE 16

Figure 18:
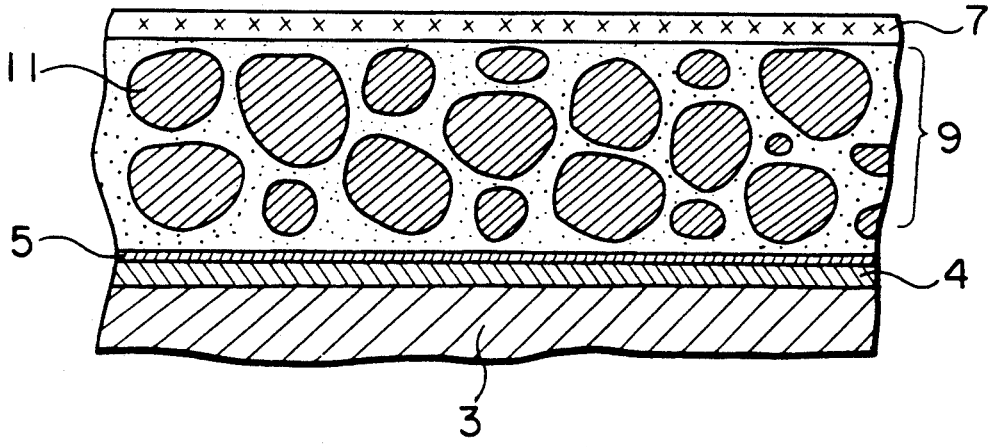

FIG. 18 is a cross-sectional view schematically showing a ceramic coating consisting of a bonding layer 4 formed on the inner surface of the iron tubular member 3, an iron oxide diffusion-preventing layer 5, a refractory layer 9 and a protective layer 7.

The bonding layer 4, the iron oxide diffusion-preventing layer 5 and the refractory layer 9 were formed in the same manner as in Example 15. After that, an aluminum phosphate solution (concentration: 40 weight %) was applied to the fired surface of the refractory layer 9, heated to 110° C. at a heating rate of 10° C./min, kept at 110° C. for 1 hour and then cooled to room temperature to form the protective layer 7 of 8 μm in thickness.

EXAMPLE 17

FIG. 19 is a cross-sectional view schematically showing a ceramic coating consisting of a bonding layer 4 formed on an inner surface of the iron tubular member 3, an iron oxide diffusion-preventing layer 5, an oxidation-preventing layer 6 and a heat-insulating layer 8.

The bonding layer 4, the iron oxide diffusion-preventing layer 5 and the oxidating-preventing layer 6 were formed in the same manner as in Example 2. Next, this iron tubular member 3 was dried by heating from room temperature to 300° C. at a heating rate of 1° C./min in a drying furnace, kept at 300° C. for 1 hour to remove excess water.

Next, ceramic microballoons having a bulk density of 0.47 and a particle size of 44–150 μm (heat-insulating material powder), crushed silica balloons (inorganic flaky particles), sodium silicate (a silicate binder ) and burned aluminum phosphate (a hardener) were mixed in the following ratio to form a mixture slurry.

| | |
|---|---|
| Sodium silicate ($SiO_2/Na_2O$ molar ratio: 3.0, concentration: 30 weight %) | 100 parts by weight |
| Ceramic balloon (<100 μm) | 20 parts by weight |
| Crushed silica balloon particles (<74 μm) | 25 parts by weight |

-continued

| | |
|---|---|
| Burned aluminum phosphate (<74 μm) | 10 parts by weight |

The above mixture slurry was applied to the dried surface of the oxidation-preventing layer 6 formed on the inner surface of the iron tubular member 3 and cured for 2 hours, and this cycle was repeated to form the heat-insulating layer 8.

In this state, it was cured at room temperature for 15 hours to cause a hardening reaction of sodium silicate and burned aluminum phosphate in the heat-insulating layer.

Next, this iron tubular member 3 was heated from room temperature to 300° C. at a heating rate of 1° C./min, kept at 300° C. for 1 hour to remove excess water in a drying furnace and then cooled to room temperature.

This iron tubular member 3 was then fired to 800° C. at a heating rate of 200° C./hr in an $N_2$ atmosphere (oxygen partial pressure: 5 mmHg), kept at 800° C. for 1 hour and then cooled to room temperature, thereby solidifying the heat-insulating layer 8 of 1500 μm in thickness.

The structure and thickness of each ceramic coating in Examples 3-17 are shown in Table 3.

TABLE 3

| Example No. | Bonding Layer | Iron Oxide Diffusion-Preventing Layer | Oxidation Preventing Layer | Heat-Insulating Layer | Refractory Layer | Protective Layer | Total |
|---|---|---|---|---|---|---|---|
| | Thickness of Each Coating Layer (μm) | | | | | | |
| 3 | 10 | 3 | 300 | — | — | — | 313 |
| 4 | 10 | 3 | 300 | 1500 | — | — | 1813 |
| 5 | 10 | 3 | 300 | 1500 | — | 8 | 1821 |
| 6 | 10 | 3 | 300 | 1500 | 1000 | — | 2813 |
| 7 | 10 | 3 | 300 | 1500 | 1000 | 8 | 2821 |
| 8 | 10 | 3 | 300 | — | 1000 | — | 1313 |
| 9 | 10 | 3 | 300 | — | 1000 | 8 | 1321 |
| 10 | 10 | 3 | — | — | — | 8 | 21 |
| 11 | 10 | 3 | — | 1500 | — | — | 1513 |
| 12 | 10 | 3 | — | 1500 | — | 8 | 1521 |
| 13 | 10 | 3 | — | 1500 | 1000 | — | 2513 |
| 14 | 10 | 3 | — | 1500 | 1000 | 8 | 2521 |
| 15 | 10 | 3 | — | — | 1000 | — | 1013 |
| 16 | 10 | 3 | — | — | 1000 | 8 | 1021 |
| 17 | 10 | 3 | 300 | 1500 | — | — | 1813 |

In order to evaluate the properties of the ceramic coatings in Examples 3-17, the following heating tests were conducted.

(1) Test Conditions

Each coated iron tubular member 3 was attached to a heating apparatus which generated a high-temperature gas by burning a propane gas, and the inner surface of the coated tubular member 3 was heated under the conditions shown in Table 4.

TABLE 4

| | |
|---|---|
| Primary air flow | 50 $Nm^3/hr$ |
| Propane gas flow | 2 $Nm^3/hr$ |
| Secondary air flow | 36 $Nm^3/hr$ |
| Heating rate | 1000° C./min |
| gas temperature | 1100° C. |
| Oxygen concentration | 11% |

(2) Corrosion Test (Test for Measuring Weight Gain by Oxidation)

The thickness of an oxide layer formed on the tubular member by heating by a combustion gas under the conditions shown in Table 4 was measured at each time by a scanning electron microscope (SEM). The results are shown in Table 5 together with Comparative Example 3 for the uncoated iron tubular member.

In the case of the ceramic coating consisting of a combination of a bonding layer and an iron oxide diffusion-preventing layer, and further optionally an oxidation-preventing layer and a protective layer, which has a relatively small thickness, the oxidation-preventing effects are about 3-6 times as high as those of the uncoated iron tubular member. Further, in the case of the ceramic coating further containing a heat-insulating layer and/or a refractory layer and thus having a relatively large thickness, an oxide layer is hardly formed, thereby showing a good anti-oxidation characteristic. This shows that a weight gain by oxidation is remarkably reduced by the heat-insulating effects of the ceramic coating.

TABLE 5

| Sample No. | Thickness of Oxide Layer (μm) after 10 hr. | 25 hr. | 40 hr. | 54 hr. | 70 hr. |
|---|---|---|---|---|---|
| Ex. | | | | | |
| 3 | 0.2 | 0.3 | 0.4 | 0.5 | 0.6 |
| 4 | 0.0 | 0.0 | 0.0 | 0.0 | 0.0 |
| 5 | 0.0 | 0.0 | 0.0 | 0.0 | 0.0 |
| 6 | 0.0 | 0.0 | 0.0 | 0.0 | 0.0 |
| 7 | 0.0 | 0.0 | 0.0 | 0.0 | 0.0 |
| 8 | 0.0 | 0.1 | 0.1 | 0.2 | 0.2 |
| 9 | 0.0 | 0.1 | 0.1 | 0.2 | 0.2 |
| 10 | 0.3 | 0.7 | 0.9 | 1.0 | 1.2 |
| 11 | 0.0 | 0.0 | 0.0 | 0.0 | 0.1 |
| 12 | 0.0 | 0.0 | 0.0 | 0.0 | 0.1 |
| 13 | 0.0 | 0.0 | 0.0 | 0.0 | 0.0 |
| 14 | 0.0 | 0.0 | 0.0 | 0.0 | 0.0 |
| 15 | 0.0 | 0.1 | 0.2 | 0.3 | 0.4 |
| 16 | 0.0 | 0.1 | 0.2 | 0.3 | 0.3 |
| 17 | 0.0 | 0.0 | 0.1 | 0.1 | 0.1 |
| Com. Ex. 3 | 1.2 | 2.1 | 2.5 | 3.2 | 3.5 |

(3) Heat Insulation Test

The surface temperature of each coated iron tubular member heated under the conditions shown in Table 4 was measured to evaluate the heat insulation of each ceramic coating. The results are shown in Table 6 together with those of Comparative Example 3 (the iron tubular member having no ceramic coating).

TABLE 6

| Sample No. | Temperature of Iron Tubular Member (°C.) Inner Surface | Outer Surface |
|---|---|---|
| Example 3 | 730 | 705 |
| Example 4 | 840 | 595 |
| Example 5 | 835 | 590 |
| Example 6 | 840 | 575 |
| Example 7 | 840 | 575 |
| Example 8 | 735 | 685 |
| Example 9 | 740 | 685 |
| Example 10 | 720 | 715 |
| Example 11 | 835 | 600 |
| Example 12 | 835 | 595 |
| Example 13 | 840 | 585 |
| Example 14 | 835 | 580 |
| Example 15 | 730 | 695 |
| Example 16 | 730 | 695 |
| Example 17 | 790 | 635 |
| Comparative Example 3 | 720 | 715 |

(4) Durability Test

Each coated iron tubular member was heated for 30 minutes under the conditions shown in Table 4 and then cooled to room temperature, and this heating and cooling cycle was repeated 100 times. As a result, none of the ceramic coatings suffered from cracking, peeling, etc., confirming that they had sufficient durability.

The function and effects of each layer in the above Examples will be explained.

On the inner surface of the metal iron tubular member 3, the bonding layer 4 having a thickness of about 10 μm was formed. This bonding layer 4, which was in a dense, glassy state, had good adhesion to the cast iron tubular member. Thus, it contributed to the bonding of the iron oxide diffusion-preventing layer 5 to the bonding layer 4.

The iron oxide diffusion-preventing layer 5 formed on the surface of this bonding layer 4 had a thickness of about 3 μm, and the oxidation-preventing layer 6 had a thickness of about 300 μm. This oxidation-preventing layer 6 was bonded strongly to the iron tubular member 3 by the bonding layer 4 via the iron oxide diffusion-preventing layer. Since the oxidation-preventing layer 6 has a structure in which flaky particles having a thickness of 0.5–2 μm and a longer diameter of 5–20 μm were laminated in a cross-linked manner, it was sufficiently flexible. It was confirmed by the evaluation tests that the oxidation-preventing layer did not suffer from cracking and peeling even after being subjected to expansion and shrinkage due to repeated heating and cooling.

The heat-insulating layer 8 had a thickness of 1500 μm. Incidentally, since the heat-insulating layer in Example 17 contained ceramic hollow particles dispersed in a matrix consisting of a mixture of inorganic flaky particles, a binder and a hardener, the heat-insulating layer was bonded strongly to the oxidation-preventing layer 6 and had sufficient flexibility to rapid heat shock and excellent heat insulation.

The refractory layer 9 as thick as 1000 μm was composed of a refractory material sufficiently durable to a high-temperature exhaust gas exceeding 1100° C., and it was strongly bonded to the heat-insulating layer 8.

Further, the protective layer 7 had a thickness of 8 μm. This protective layer 7 was a thin, dense layer, covering the pores of the iron oxide diffusion-preventing layer 5, the oxidation-preventing layer 6, the heat-insulating layer 8 and the refractory layer 9, thereby preventing the penetration of harmful gases to the iron oxide diffusion-preventing layer 5.

Although the ceramic coatings applicable to manifolds are described in Examples, they are similarly applicable to port liners, front tubes, turbo chargers, etc.

As described above in detail, since the ceramic coating formed on an iron tubular member according to the present invention comprises, as its indispensable layers, the bonding layer serving to strengthen the bonding of the ceramic coating to the iron tubular member and the iron oxide diffusion-preventing layer consisting of fine metal oxide particles or organometallic binders, and if necessary, the oxidation-preventing layer having a structure in which inorganic flaky particles are laminated in a cross-linked manner, the heat-insulating layer mainly composed of inorganic hollow particles, the refractory layer and the protective layer, the ceramic coating is not likely to be subjected to discoloration (blackening) and highly resistant to peeling, cracking and corrosion under high-temperature conditions. Therefore, when the ceramic coating formed on an iron tubular member of the present invention is used for exhaust equipment of internal engines, etc., it can sufficiently endure repeated heat shock generated by an exhaust gas exceeding 800° C. In addition, it can show excellent corrosion resistance and heat resistance without changing its color, thereby enjoying an increased service life. Further, when the protective layer is formed, it covers the pores of the oxidation-preventing layer, etc., thereby preventing the penetration of harmful gases into the oxidation-preventing layer and the iron oxide diffusion-preventing layer.

The ceramic coating having such advantages can be used in exhaust gas manifolds for internal engines, and other various members such as exhaust pipes, port liners, turbo chargers, etc.

We claim:

1. A coated iron tubular member comprising a first layer formed on a surface of said iron tubular member by a reaction of an iron oxide layer of said iron tubular member and a silicate; and an iron oxide diffusion-preventing layer formed on a surface of said first layer, said iron oxide diffusion preventing layer being produced from a material selected from the group consisting of fine metal oxide particles and organometallic compositions, which material does not form a low-melting point product with iron oxide, by firing said material on the surface of said first layer.

2. The coated iron tubular member according to claim 1, further comprising a thin, dense protective layer composed of an inorganic material and/or an organometallic material on a surface of said iron oxide diffusion-preventing layer.

3. The coated iron tubular member according to claim 1, further comprising an oxidation-preventing layer comprising inorganic flaky particles consolidated by firing to have a cross-linked laminate structure on a surface of said iron oxide diffusion-preventing layer.

4. The coated iron tubular member according to claim 3, wherein said inorganic flaky particles are those produced by crushing natural or artificial mica, thin glass or inorganic hollow particles.

5. The coated iron tubular member according to claim 3, further comprising a thin, dense protective layer comprised of an inorganic material and/or an organometallic material on a surface of said oxidation-preventing layer.

6. The coated iron tubular member according to claim 3, further comprising a heat-insulating layer formed by firing a heat-insulating material mainly composed of inorganic hollow particles on a surface of said oxidation-preventing layer.

7. The coated iron tubular member according to claim 6, further comprising a thin, dense protective layer composed of an inorganic material and/or an organometallic material on a surface of said heat-insulating layer.

8. The coated iron tubular member according to claim 6, further comprising a refractory layer formed by firing a refractory material mainly composed of inorganic particles on a surface of said heat-insulating layer.

9. The coated iron tubular member according to claim 8, further comprising a thin, dense protective layer composed of an inorganic material and/or an organometallic material on a surface of said refractory layer.

10. The coated iron tubular member according to claim 3, further comprising a refractory layer formed by firing a refractory material mainly composed of inorganic particles on a surface of said oxidation-preventing layer.

11. The coated iron tubular member according to claim 10, further comprising a thin, dense protective layer composed of an inorganic material and/or an organometallic material on a surface of said refractory layer.

12. The coated iron tubular member according to claim 1, further comprising a heat-insulating layer formed by firing a heat-insulating material mainly composed of inorganic hollow particles on a surface of said iron oxide diffusion-preventing layer.

13. The coated iron tubular member according to claim 12, further comprising a thin, dense protective layer composed of an inorganic material and/or an organometallic material on a surface of said heat-insulating layer.

14. The coated iron tubular member according to claim 12, further comprising a refractory layer formed by firing a refractory material mainly composed of inorganic particles on a surface of said heat-insulating layer.

15. The coated iron tubular member according to claim 14, further comprising a thin, dense protective layer composed of an inorganic material and/or an organometallic material on a surface of said refractory layer.

16. The coated iron tubular member according to claim 1, further comprising a refractory layer formed by firing a refractory material mainly composed of inorganic particles, on a surface of said iron oxide diffusion-preventing layer.

17. The coated iron tubular member according to claim 16, further comprising a thin, dense protective layer composed of an inorganic material and/or an organometallic material on a surface of said refractory layer.

18. The coated iron tubular member according to claim 1, wherein said iron tubular member is part of exhaust equipment.

19. A layered product for use in a high-temperature oxidizing atmosphere comprising:

an iron member having a surface;

a first layer formed on said iron member surface by a reaction of an iron oxide layer on said iron member surface and a silicate, said first layer having a surface; and an iron oxide diffusion preventing layer formed on said surface of said first layer, said iron oxide diffusion preventing layer being formed by firing a material which does not form a low-melting point product with iron oxide.

20. The layered produce as in claim 2 wherein said iron oxide diffusion preventing layer is produced from a material selected from the group consisting of metal oxide particles and organometallic compositions by firing said material on said first layer surface.

* * * * *

UNITED STATES PATENT AND TRADEMARK OFFICE

CERTIFICATE OF CORRECTION

PATENT NO. : 5,167,988

DATED : December 1, 1992

INVENTOR(S) : YANO et al

It is certified that error appears in the above-identified patent and that said Letters Patent is hereby corrected as shown below:

Claim 20, col. 24, line 36, "produce" should read --product--; and "claim 2" should read --claim 19--.

Signed and Sealed this

Nineteenth Day of October, 1993

*Attest:*

*Attesting Officer*

BRUCE LEHMAN

*Commissioner of Patents and Trademarks*